US009017100B2

(12) United States Patent
Lai et al.

(10) Patent No.: US 9,017,100 B2
(45) Date of Patent: Apr. 28, 2015

(54) ELECTRICAL CONNECTOR

(71) Applicant: Giga-Byte Technology Co., Ltd., New Taipei (TW)

(72) Inventors: Chih Ming Lai, New Taipei (TW); Chung Wei Chiang, New Taipei (TW)

(73) Assignee: Giga-Byte Technology Co., Ltd., New Taipei (TW)

( * ) Notice: Subject to any disclaimer, the term of this patent is extended or adjusted under 35 U.S.C. 154(b) by 100 days.

(21) Appl. No.: 13/865,198

(22) Filed: Apr. 18, 2013

(65) Prior Publication Data

US 2014/0170883 A1 Jun. 19, 2014

(30) Foreign Application Priority Data

Dec. 19, 2012 (TW) ..... 101148459 A

(51) Int. Cl.
*H01R 12/70* (2011.01)

(52) U.S. Cl.
CPC ..... *H01R 12/7029* (2013.01)

(58) Field of Classification Search
USPC ..... 439/571–573, 567, 564, 943, 948
See application file for complete search history.

(56) References Cited

U.S. PATENT DOCUMENTS

| | | | | | |
|---|---|---|---|---|---|
| 4,045,868 | A * | 9/1977 | Ammon et al. | ..... | 29/845 |
| 4,753,602 | A * | 6/1988 | Peyrat et al. | ..... | 439/78 |
| 5,320,549 | A * | 6/1994 | Schempp et al. | ..... | 439/246 |
| 5,632,649 | A * | 5/1997 | Spangler | ..... | 439/567 |
| 6,000,965 | A * | 12/1999 | Hsiao et al. | ..... | 439/567 |
| 6,371,803 | B1 * | 4/2002 | Fan | ..... | 439/570 |
| 7,052,317 | B2 * | 5/2006 | Hara et al. | ..... | 439/567 |
| 7,186,152 | B2 * | 3/2007 | Chen | ..... | 439/733.1 |
| 8,025,507 | B2 * | 9/2011 | Kim et al. | ..... | 439/79 |
| 8,636,528 | B2 * | 1/2014 | Sass et al. | ..... | 439/157 |
| 2011/0045693 | A1 * | 2/2011 | Uchida | ..... | 439/567 |

* cited by examiner

*Primary Examiner* — Gary Paumen
(74) *Attorney, Agent, or Firm* — Chun-Ming Shih

(57) ABSTRACT

An electronic connector includes a body and a fixing member penetrating through the body. A fastening section of the fixing member is inserted in the body, and an extending section of the fixing member protrudes from the body. The fastening section withstands a block portion of the body toward the extending section inside the body. In this way, when the electronic connector is assembled with a circuit board, the body of the electronic connector is fixed to the circuit board by the fastening section of the fixing member, for avoiding the body separating from the fixing member.

8 Claims, 6 Drawing Sheets

ELECTRICAL CONNECTOR

CROSS-REFERENCES TO RELATED APPLICATIONS

This non-provisional application claims priority under 35 U.S.C. §119(a) on Patent Application No. 101148459 filed in Taiwan, R.O.C. on Dec. 19, 2012, the entire contents of which are hereby incorporated by reference.

BACKGROUND

1. Technical Field

This disclosure relates to an electronic connector, and more particularly to an electronic connector according to Peripheral Component Interconnect Express protocol.

2. Related Art

The general mean to fix an electronic connector to a circuit board is mainly by making the fixing member of the electronic connector run through the positioning hole in the circuit board, so as to temporally fix the electronic connector to a proper position of the circuit board in advance. Then the fixing member is soldered to the circuit board to be bond to the circuit board.

The conventional electrical connector assembly method is to dispose a blind hole on the insulation body of the electrical connector at first, and then to squeeze one end of the fixing member into the blind hole by a man or a machine, so that the fixing member is bonded to the insulation body in a tight-fitting manner. Besides, the fixing member has hooks or a serrated structure on two sides thereof, in order to make the bonding tighter.

When the electronic connector is bonded to the circuit board, one end of the fixing member is fixed to the insulation body in the tight-fitting manner, while the other end of the fixing member is bonded to the circuit board in a soldering manner, so that the bonding force between the fixing member and the circuit board is larger than the bonding force between the fixing member and the insulation body. Therefore, if circuit boards equipped with the electronic connector encounter impact during transportation, the fixing member is easy to separate from the insulation body, leading to the damage of the electronic connector and the circuit board. The situation is particularly common when the electronic connector inserted with electronic products with a certain weight such as video cards.

Therefore, how to improve the bonding strength between the fixing member and the insulation body of the electronic connector has become an important issue.

SUMMARY OF THIS DISCLOSURE

In view of the above problems, this disclosure provides an electronic connector, so as to solve the issue that the fixing members of conventional electronic connectors are easy to separate from the insulation body.

The electronic connector includes a body and a fixing member. The body includes a first side surface, and a second side surface, and an installation hole communicating the first side surface and the second side surface. The radius of the installation hole on the first side surface is larger than that on the second side surface, and a block portion is formed in the installation hole. The fixing member includes a fastening section and an extending section. The fastening section is inserted in the body and withstands a block portion of the body toward a direction from the first side surface to the second side surface, and the extending section is connected with the fastening section and protrudes from the second side surface of the body.

Because the fixing member withstands the block portion of the body inside the installation hole, the body can not move toward the direction of the fastening section of the fixing members. Therefore, when the extending section of the fixing member is soldered with the circuit board, the body will be fixed in between the fastening section of the fixing member and the circuit board, so as to avoid the body separating from the fixing member.

The detail of this disclosure can be better appreciated from the following detailed description of this disclosure, taken in conjunction with the attached drawings.

BRIEF DESCRIPTION OF THE DRAWINGS

This disclosure will become more fully understood from the detailed description given herein below for illustration only, and thus not limitative of this disclosure, wherein.

DETAILED DESCRIPTION OF THE DISCLOSURE

Figure 1:
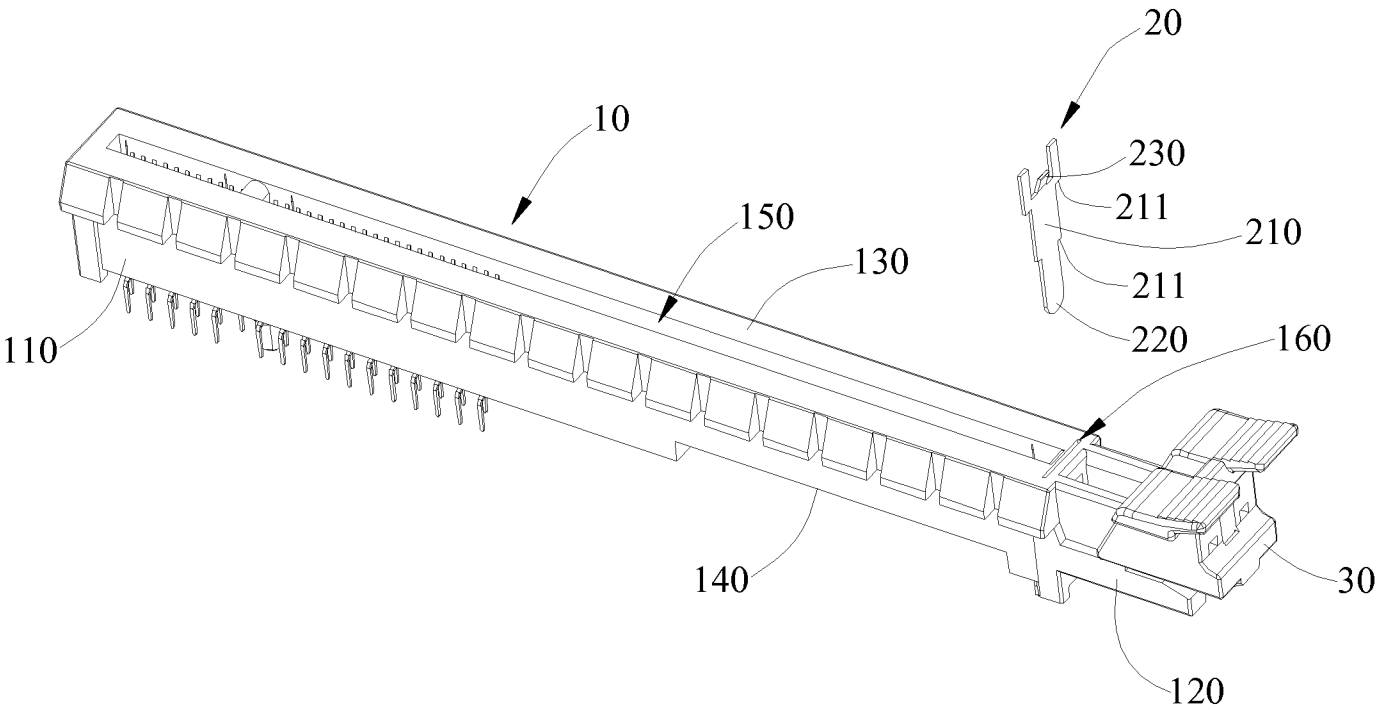
FIG. 1 is a partial exploded view of the electronic connector according to a first embodiment.
Figure 2:
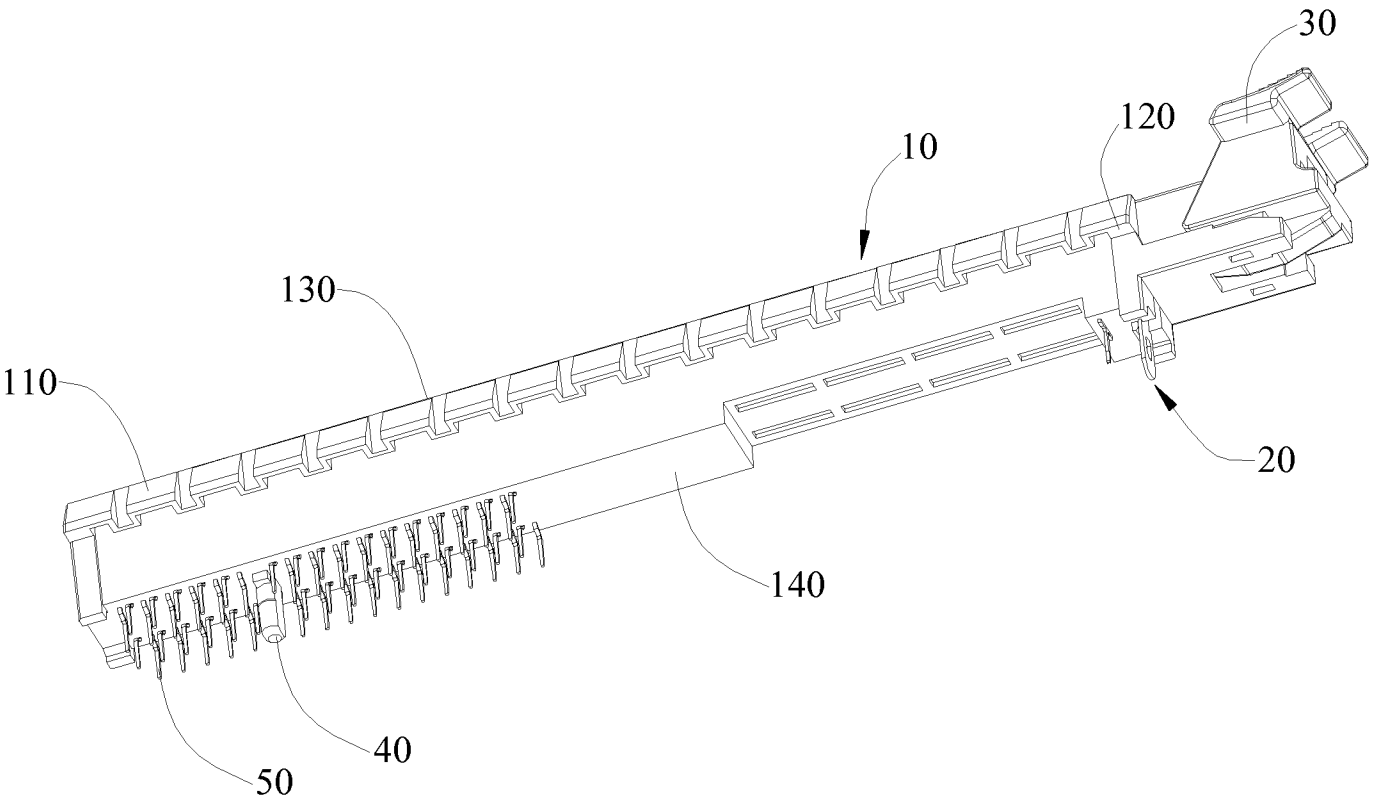
FIG. 2 is a perspective view of the electronic connector according to the first embodiment.
Figure 3:
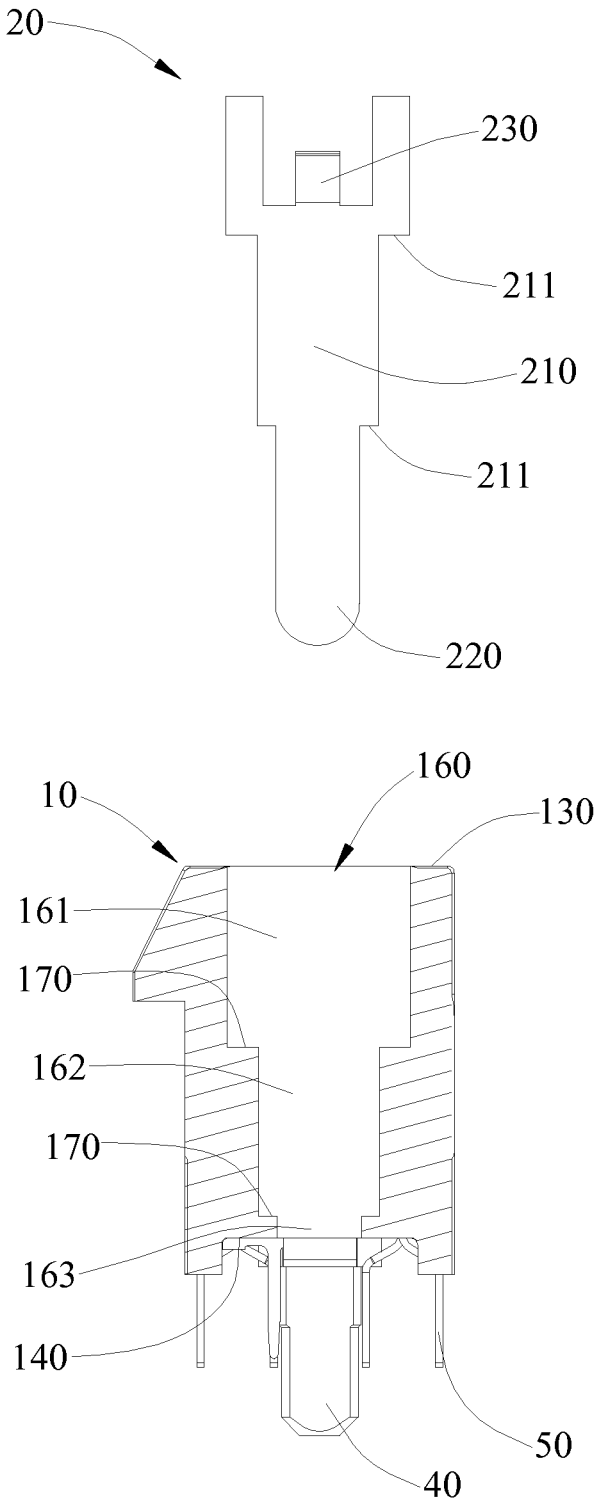
FIG. 3 is a partial exploded view of the electronic connector from another perspective according to the first embodiment.
Figure 4:
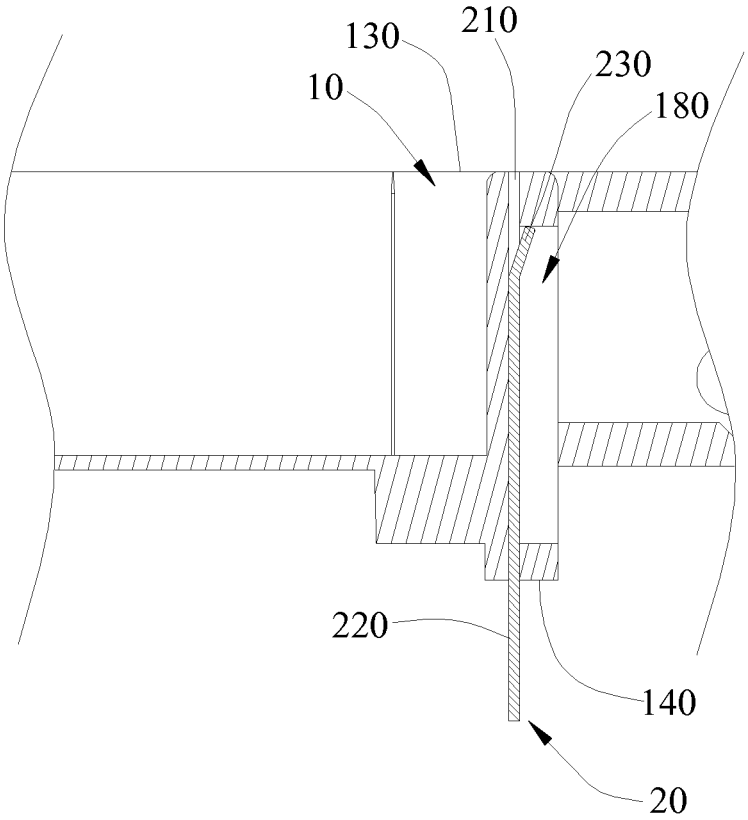
FIG. 4 is a cross-sectional view of the electronic connector according to the first embodiment.

Refer to FIG. 1 to FIG. 4, the electronic connector according to the first embodiment includes a first body 10 and a fixing member 20. The body 10 includes a first end 110, a second end 120, a first side surface 130, and a second side surface 140. The first end 110 or/and the second end 120 could be optionally pivotally connected to a latching member 30, so as to combine or separate a circuit board and the body 10. The first side surface 130 and the second side surface 140 respectively connect with the first end 110 and the second end 120, and a positioning member 40 and a plurality of conductive terminals 50 are disposed on the second side surface 140 and near the first end 110. The conductive terminals 50 are disposed with intervals with each other.

A recessed portion could be optionally disposed on the second side surface 140 and near the second end 120, and R angles can be set at the two ends of the recessed portion. The structure improvement can increases the structure strength of the body 10. In the press-breaking force test, when the first end 110 of the body 10 is fixed to the testing machine and the external force is applied at the second end 120 of the body 10, the external force that the body 10 is able to withstand dramatically increases from 11.94 to 12.23 kg to 25.69 to 27.34 kg.

A slot 150 and an installation hole 160 are formed on the first side surface 130 of the body 10, and the slot 150 extends from the first end 110 to the second end 120. The installation hole 160 is disposed near the second end 120 and the slot 150 and communicates the first side surface 130 and the second side surface 140. The installation hole 160 forms a first passage 161, a second passage 162, and a third passage 163, and the widths of these passages are from large to small toward a direction from the first side surface 130 to the second side surface 140, such that the radius of the installation hole 160 on the first side surface 130 is larger that on the second side surface 140, and a ladder-shaped block portion 170 is formed inside the installation hole 160.

The fixing member 20 includes a fastening section 210 and an extending section 220, and these two sections are connected with each other. The width of the fastening section 210 of the fixing member 20 is larger than that of the extending section 220, so that a withstanding portion 211 is formed in the end of the fastening section 210 connected to the extending section 220. The withstanding portion 211 corresponds to the block portion 170 between the second passage 162 and the third passage 163. The width of the fastening section converges toward the extending portion 220 corresponding to the widths of the first passage 161 and the second passage 162, such that the shape of the fastening section 210 matches that of the installation hole 160 of the body 10. And another withstanding portion 211 is formed in the fastening section 210, so as to correspond the block portion 170 between the first passage 161 and the second passage 162.

About the assembling, the fixing member 20 is inserted into the installation hole 160 toward the direction from the first side surface 130 to second side surface 140, and the extending section 220 and the fastening section 210 are inserted in sequence. When the fastening section 210 moves for a pre-determined distance, a plurality of the withstanding portions 211 of the fastening section 210 withstands a plurality of the block portions 170 in the installation hole 160, such that the fastening section 210 will be blocked by the block portions 170 if the fastening section 210 moves toward the second side surface 140 of the body 10 and that the fastening section 210 is fixed in an installation hole 160 in a tight-fitting manner. At this time, the extending section 220 of the fixing member 20 runs through the second side surface 140 of the body 10 by the installation hole 160 and protrudes the body 10, in order to solder the extending section 220 with the circuit board when the electronic connector is assembled with the circuit board.

Therefore, when the electronic connector is assembled with the circuit board, the fastening section 210 of the fixing member 20 withstands the block portions 170 of the body 10, such that the body is fixed to the circuit board. The extending section 220 of the fixing member 20 runs through the circuit board and is fixed on the other side of the circuit board by soldering, such that the body 10 is fixed in between the fastening section 210 of the fixing member 20 and the circuit board and that the body 10 is unable to move toward the direction from the extending section 220 to the fastening section 210, making the fixing member 20 unable be separated from the body 10.

In the pullout force test, when the external force of 18.29 to 20.92 kg is applied to pull the body of the electronic connector out, the force is still unable to separate the body and the fixing member. Therefore, compared with common electronic connectors, in which the body and the fixing member are separated when a external force of 4.03 to 7.57 kg is applied, the technical mean of combining the fixing member and the body of this disclosure effectively strengthens the bonding of the body and the fixing member and the stability of the combination of the body and the fixing member.

For enhancing the stability of the combination of the fixing member 20 and the body 10, a restriction section 230 could selectively be disposed in the fixing member 20. One end of the limiting section 230 is connected to the fastening section 210, and the other end extends toward the direction from the extending section 220 to the fastening section 210. The restriction section 230 inclines relative to the fastening section 210. Meanwhile, the inner wall of installation hole 160 of the body 10 forms a depression 180. The depression 180 corresponds to the restriction section 230 in the fixing member 20 and inclines inwardly toward the direction from the second side surface 140 to the first side surface 130 of the body 10. When the fastening section 210 of the fixing member 20 withstands the block portion 170 in the installation 160, the restriction section 230 of the fixing member 20 is able to just stretch into the depression 180 and withstand the body 10 in the depression 180 toward the first side surface 130 of the body 10.

Therefore, the movement of the fixing member 20 among the first side surface 130 and the second side surface 140 is limited by the block portion 170 and the depression 180 in the installation hole 160, such that the fixing member 20 is fixed to the body 10 and does not separate from the body 10.

Figure 5:
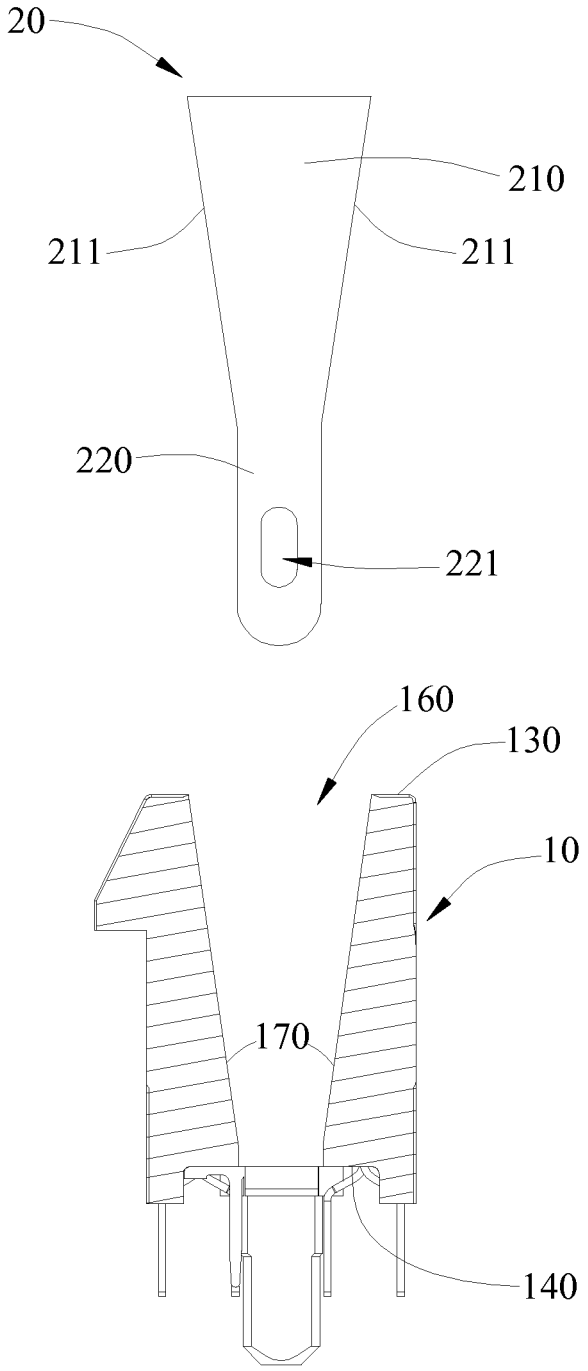
FIG. 5 is a partial exploded view of the electronic connector according a second embodiment.
Figure 6:
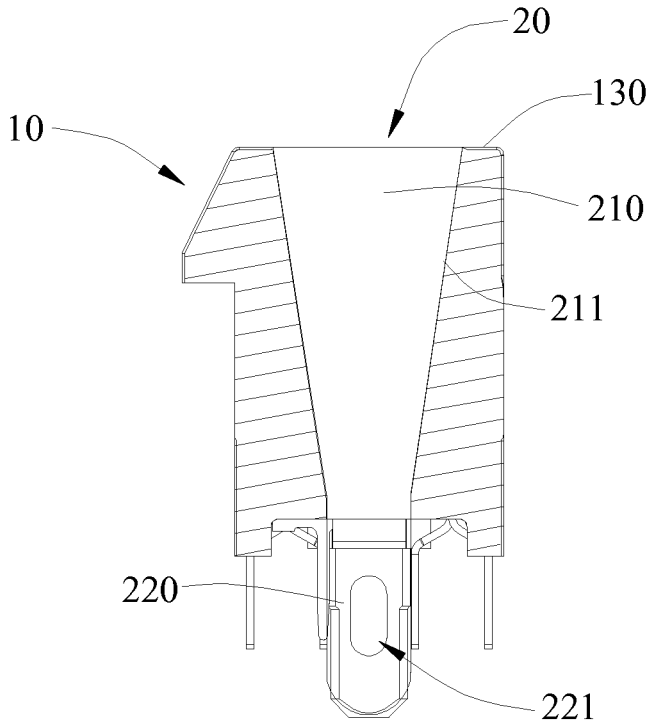
FIG. 6 is a cross-sectional view of the electronic connector according to the second embodiment.

Refer to FIG. 5 and FIG. 6, the structure of this disclosure according the second embodiment is similar to that according to the first embodiment. The only difference between these two is that in the electronic connector according to the second embodiment, the radius of the installation hole of the body gradually decreases toward the direction from the first side surface 130 to the second side surface 140, such that a block portion 170 connects between the first side surface 130 and the second side surface 140 in a tilt manner. Similarly, the width of the fastening section 210 of the fixing member 20 gradually decreases toward the extending section 220 and matches the radius of the installation hole 160, such that the two sides of the fastening section 210 are aslant connected to the extending section 220 and form withstanding portions 211. Therefore, about the assembling, the fixing member 20 correspondingly withstands the block portion 170 inside the installation hole 160 of the body 10 by the withstanding portions 211 of the fastening section 210 and is stably fixed to the body 10. Besides, when the electronic connector is assembled with the circuit board, this structure is able to avoid the body 10 separates from the fixing member 20 toward the fastening section 210 of the fixing member 20 as well.

For enhancing the stability of the combination of the fixing member 20 and the circuit board, an aperture 221 is disposed in the extending section 220 of the fixing member 20. When the extending section 220 runs through the circuit board, the body 10 and aperture 221 are spaced by the circuit board. Therefore, when the extending section 220 of the fixing member 20 is soldered to the circuit board, except covering the surface of the extending section 220, the solder could runs through the extending section 220 via the aperture 221 to limit the extending section 220 from moving toward the circuit board, so as to avoid the fixing member 20 separating from the circuit board.

In the electronic connector of this disclosure, the extending section of the fixing member runs through the body, and the fastening section withstands the body, so as to fix the electronic connector in between the fastening section and the extending section (or circuit board), solving the issue that the fixing member is easy to separate from the body.

Though the embodiments of this disclosure are disclosed as described above, this is not to limit this disclosure. People having ordinary skill in the art will recognize that this disclosure can be practiced with modification within the spirit and scope of the claim. It is therefore to be understood that this disclosure is not to be limited by the foregoing description but only by the appended claims.

What is claimed is:

1. An electronic connector, comprising:

a body, including a first side surface, a second side surface, and a installation hole communicating the first side surface and the second side surface, wherein the radius of the installation hole on the first side surface is larger than the radius of the installation hole on the second side surface, and a block portion is formed in the installation hole, wherein the body further includes a depression, wherein the depression is formed on the inner wall of the installation hole and inclines inwardly toward the direction from the second side surface to the first side surface of the body; and a fixing member, including a fastening section and an extending section; wherein the fastening section is disposed in the installation hole and inserted in the body to withstands the block portion of the body toward a direction from the first side surface to the second side surface, and the extending section is connected with the fastening section and protrudes from the second side surface of the body, wherein the fixing member further includes a restriction section, one end of the restriction section is connected to the fastening section, and the other end of the restriction section inclines toward the direction from the extending section to the fastening section, wherein the restriction section stretches into the depression and withstands the body in the depression.

2. The electronic connector as claimed in claim 1, wherein the installation hole includes a first passage and a second passage, the width of the first passage is larger than the width of the second passage, the block portion is formed between the first and the second passage.

3. The electronic connector as claimed in claim 2, wherein the width of the fastening section is larger than the width of the extending section, and a withstanding portion is formed at the end of the fastening section connected to the extending section and withstands the block portion.

4. The electronic connector as claimed in claim 1, wherein the radius of the installation hole converges from the first side surface to the second side surface, the block portion connects the first side surface to the second side surface in a tilt manner, and the width of the fixing member converges from the fastening section to extending section and matches the radius of the installation hole.

5. The electronic connector as claimed in claim 1, wherein the extending section of the fixing member further has an aperture.

6. The electronic connector as claimed in claim 1, wherein the body further includes a positioning member, a first end, and a second end, the positioning member is disposed on the second side surface and near the first end, and the fixing member is disposed near the second end.

7. The electronic connector as claimed in claim 6, further including a plurality of conductive terminals, wherein the conductive terminals are disposed with intervals among each other on the second side surface.

8. The electronic connector as claimed in claim 6, further including a latching member pivotally connected to the first end or the second end of the body.

* * * * *